US005788417A

United States Patent [19]

Fontenot et al.

[11] Patent Number: 5,788,417

[45] Date of Patent: Aug. 4, 1998

[54] OFFSHORE WELL STABILIZATION APPARATUS AND METHOD

[75] Inventors: Ozeman J. Fontenot, Mamou; Robert R. Carruth; Louis J. Hoffpauir, both of Lafayette, all of La.

[73] Assignee: American Oilfield Divers, Inc., Houston, Tex.

[21] Appl. No.: 573,594

[22] Filed: Dec. 15, 1995

Related U.S. Application Data

[63] Continuation of Ser. No. 398,447, Mar. 3, 1995, abandoned.

[51] Int. Cl.[6] ..... E02B 17/00

[52] U.S. Cl. ..... 405/224; 405/195.1; 166/368; 254/228

[58] Field of Search ..... 405/204, 202, 405/224, 224.4, 224.2, 195.1, 225, 227, 216; 166/350, 359, 367, 341–343, 345, 368; 52/149, 150, 152; 254/228, 232

[56] References Cited

U.S. PATENT DOCUMENTS

| | | | |
|---|---|---|---|
| 657,980 | 9/1900 | Falcon . | |
| 3,188,816 | 6/1965 | Koch | 405/225 |
| 3,387,460 | 6/1968 | Morris . | |
| 3,881,549 | 5/1975 | Thomas . | |
| 4,011,694 | 3/1977 | Langford | 52/149 X |
| 4,023,374 | 5/1977 | Colbert et al. | 405/216 |
| 4,170,186 | 10/1979 | Shaw . | |
| 4,367,982 | 1/1983 | Hubbard . | |
| 4,430,023 | 2/1984 | Hayes et al. . | |
| 4,552,486 | 11/1985 | Knox et al. | 405/225 X |
| 4,597,350 | 7/1986 | Mott . | |
| 4,640,647 | 2/1987 | Blair et al. . | |
| 4,710,061 | 12/1987 | Blair et al. . | |
| 4,721,416 | 1/1988 | Gracia | 405/225 X |
| 4,818,146 | 4/1989 | Fontenot . | |
| 4,993,876 | 2/1991 | Snow et al. | 405/216 |
| 5,028,171 | 7/1991 | Gray | 405/225 |
| 5,277,406 | 1/1994 | Knight | 254/228 |
| 5,498,107 | 3/1996 | Schatzle, Jr. | 405/195.1 X |

FOREIGN PATENT DOCUMENTS

| | | |
|---|---|---|
| 0013602 | 7/1980 | European Pat. Off. . |

*Primary Examiner*—Tamara L. Graysay
*Assistant Examiner*—Frederick L. Lagman
*Attorney, Agent, or Firm*—Browning Bushman

[57] ABSTRACT

An offshore well is stabilized by at least three cables connected on one end to hydraulically powered cable tensions on the well casing at a location substantially below the surface of the body of water in which the well is located and on an opposite end to a respective anchor pile on the bottom body of water. The cables are equally tensioned by the hydraulically powered cylinder and are subsequently retained in taut condition by mechanical retainers.

8 Claims, 4 Drawing Sheets

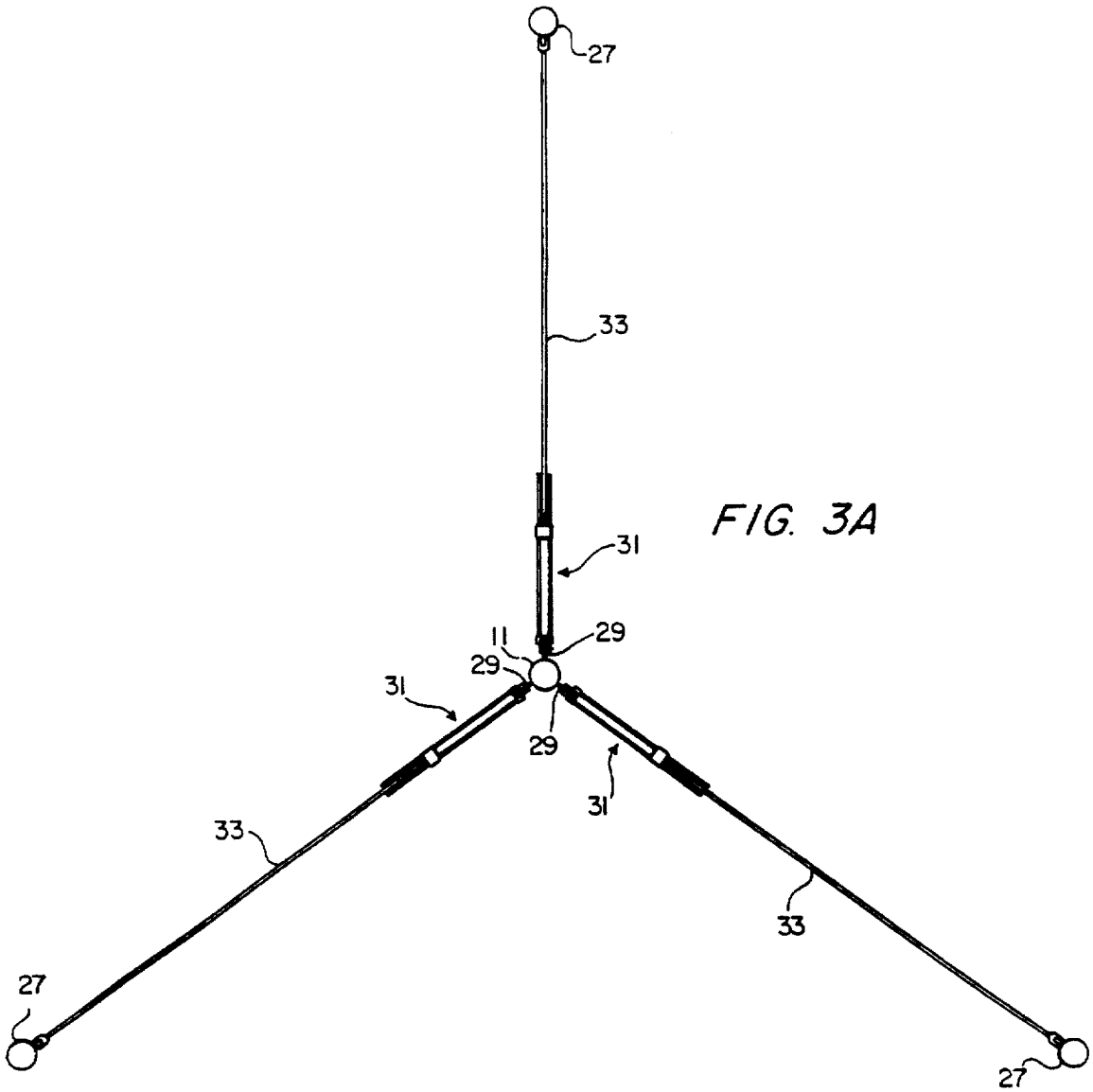
FIG. 3A
FIG. 3B
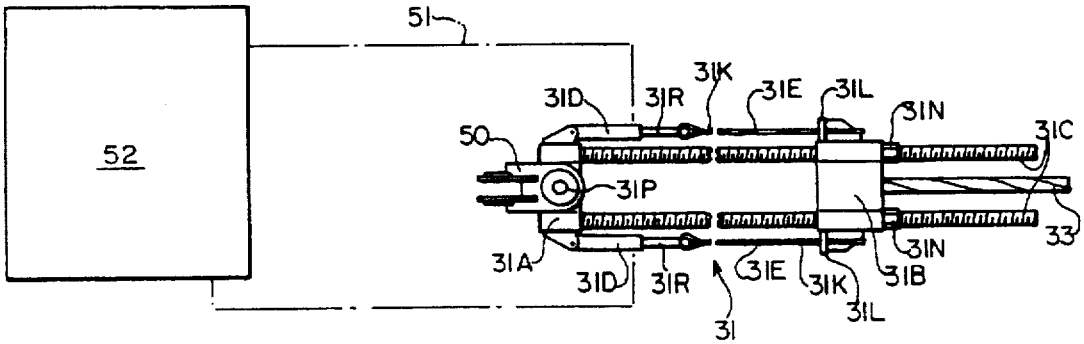

OFFSHORE WELL STABILIZATION APPARATUS AND METHOD

This is a continuation of U.S. application Ser. No. 08/398,447, filed on Mar. 3, 1995, now abandoned.

BACKGROUND OF THE INVENTION

1. Field of the Invention

This invention relates to offshore well structures that are self-supporting. More particularly, this invention relates to apparatus and method for expeditiously for stabilizing, saving and protecting an offshore well that has been completed in a depth of water; the apparatus and method also allows boat maneuvering around the well while also providing self-supporting capability and stability even in deep water.

2. Related Art

The prior art has seen the development of a wide variety of types of wellhead completions for offshore wells for producing hydrocarbonaceous materials from subterranean formations. Prior art well completions have included completions on the bottom of exceptionally deep water through platforms and offshore structures such as illustrated and described in "INTRODUCTION TO OFFSHORE STRUCTURES, DESIGN, FABRICATION, INSTALLATIONS", W. J. Graff, Gulf Publishing Co., Houston, Tex. 1981 and have also included relatively easy completions in shallow water such as in Lake Maracaibo or similar shallow water of only a few tens of feet depth or less. The deep water completions have been exotic and required very expensive transponders and the like. The shallow water completions have been very expensive in that they have employed multiple wells and large reserves. Even completing intermediate depths has frequently required divers to go to the bottom to work on the wellhead where diving depths were feasible. On the other hand, many shallow depth completions have been relatively simple and have not been regulated by the MMS (Minerals Management Service) or other regulatory agencies which do not wish for boat maneuvering or navigation to be impeded unnecessarily. More frequently there is a demand for a method of saving wells that have been completed in intermediate depth water ranging from less than 100 feet to as much as 300 or more feet in depth. The types of recovery and types of wells drilled and completed in such intermediate depths of water are not as exotic as the offshore wells in exceptionally deep water, yet the methods of completing in very shallow water wells are not satisfactory for providing a self-supporting well structure in intermediate depths.

Illustrative of the prior art type completions which have been found satisfactory in intermediate depths of water are those found in U.S. Pat. Nos. 4,640,647; 4,710,061, and 4,818,146 which employ complicated mechanical tensioning means for guy cables connected to an offshore well casing and respective anchor piles; devices of the last-mentioned type do not permit an easy assurance of uniform guy cable tensioning so that the well casing may be subjected to unbalanced forces so as to create a potential hazard.

Other prior art well stabilization structures have required exceptionally large, heavy, outside pipe fitted over threading to be self-supporting in intermediate depth water. Because the large pipe is so heavy, it requires boats and lift barges to do the remedial work on the well. Ordinarily, it would be much more convenient to have the well standing adjacent or included within a platform structure. However, if the well is a discovery well, a platform structure probably would not be available for at least a year. Consequently, prior to the present invention, the prior art structure illustrated in FIG. 1 has usually been employed for saving such wells.

From the foregoing it can be seen that the prior art has not provided a fully satisfactory method or apparatus for saving an offshore well and providing a self-supporting well that is adequate for intermediate depths of water yet sufficiently inexpensive to be economically feasible. Specifically, the greatest shortcoming of prior art has been the frequently required use of expensive boats and lift barges to do remedial work on wells employing a large structurally adequate pipe mounted over the casing.

SUMMARY OF THE INVENTION

Accordingly, it is an object of this invention to provide method and structure that is satisfactory for providing temporary, as well as permanent, well completion to save one or more offshore wells, while obviating the necessity to resort to boats and lift barges to perform the remedial work necessary to save and maintain the well as a self-supporting entity.

It is a particular object of this invention to provide improved economical, readily employed apparatus and a method for completing a self-supporting offshore well in intermediate depths of water and which insures that the well is not subject to unbalanced stabilization forces. These and other objects will become more apparent from the descriptive matter hereinafter, particularly when taken in conjunction with the appended drawings.

In accordance with all embodiments of this invention, there is provided improved offshore well apparatus for a well completed in an intermediate depth of water. The well employs a main casing penetrating downwards through the subterranean formations below the bottom of the body of water and also protruding upwardly through the water with the wellhead being affixed above the surface of the water. The wellhead includes valves and connecting tubing extending downward interiorly of the main casing to the subsurface completions. A boat landing is normally disposed about the main casing.

The improvement is characterized by a plurality of at least three anchor piles driven about the well and connected to the well by guy cables at respective azimuths for anchoring the protruding main casing against lateral current, wind, wave or other forces. In the first embodiment of the invention, a termination clamp is connected to the casing at a predetermined distance below the surface of the water with the plurality of at least three guy cables being connected respectively at their outer ends (relative to the well) to the anchor piles and being connected at their upper or inner ends to the termination clamp by one of three hydraulically operated tensioning devices each of which is associated with one of the cables for tensioning the cable to retain the well against movement from its vertical orientation that might otherwise be caused by lateral wind, current or other forces on the well. Since the upper ends of the guy cables are spaced a substantial distance below the surface of the water, boats can maneuver about the boat landing without becoming entangled in the cables or having their props fouled by the cables. The hydraulically operated tensioning devices insure that the cables are placed in equal tension; the cables are then mechanically restrained so as to permit removal of the hydraulic components.

BRIEF DESCRIPTION OF THE DRAWINGS

The invention is better understood by reading the following Detailed Description of the preferred embodiments with reference to the accompanying drawing figures, in which like reference numerals refer to like elements throughout, and in which:

FIG. 3A is a plan view of the FIG. 2 apparatus looking in the direction of arrows 3A in FIG. 2.

FIG. 3B is a plan view of the hydraulically operated apparatus connected to the upper end of each of the cables and to the casing for then tensioning the cables;

DETAILED DESCRIPTION OF THE PREFERRED EMBODIMENTS

While the method and apparatus of the subject invention may have multiple uses in fresh water or salt water applications, it will be described hereinafter with respect to use in an intermediate depth body of water such as would more frequently occur offshore in a saline environment. Thus, where there would be a need for boats to be able to maneuver unimpeded by laterally traversing cables near the surface.

Figure 1:
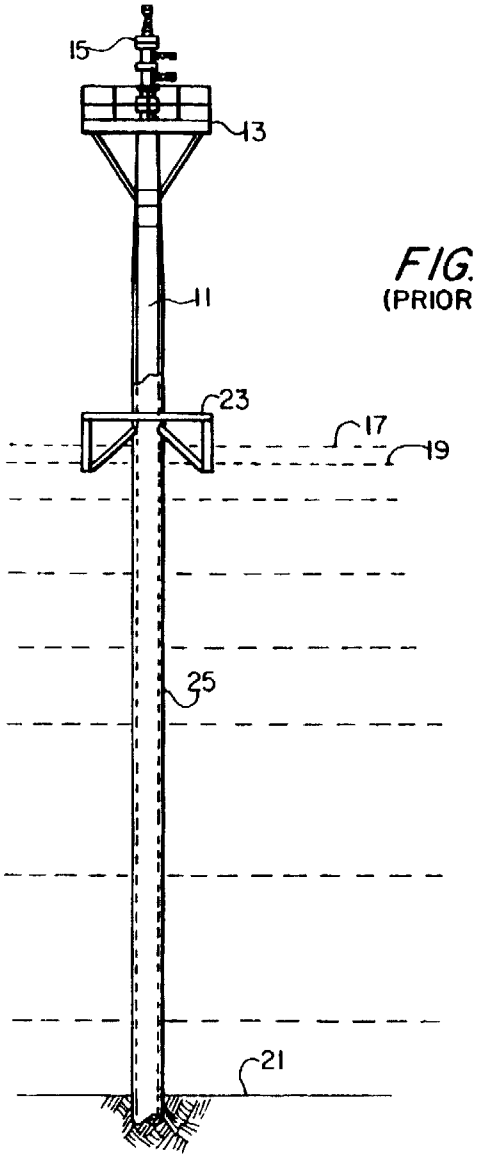
FIG. 1 (PRIOR ART)
FIG. 1 is a side elevation of a typical prior art well positioned in a body of water.

FIG. 1 illustrates a typical prior art well installation which has been found satisfactory when the water depth is of intermediate depth in the range of from 60 to 200 feet. The illustrated well employs a central or main casing 11 that supports a platform deck 13 and wellhead 15 above the surface 17 of the body of water 19. The water may range from 60 feet to as much as 200 feet or more above the bottom 21 of the body of water. A boat landing 23 is supported for allowing access to the well for a variety of purposes such as maintenance, control and inspection.

The method of preserving a well completion when an individual well is drilled is frequently referred to as "saving" a well. A drilling entity usually moves onto a location and drills through a well's 30 inch main casing commonly referred to as a conductor pipe. After completion, the well is turned over to the facilities group to complete the caisson, the purpose being to provide a self-supporting well structure throughout its useful life.

Prior to the present invention, one type of supporting structure was provided by driving a larger pipe 25 over the existing well casing 11. The larger pipe is usually a 48 inch or 60 inch pipe with 1 to 2 inch wall thickness which is positioned as shown in FIG. 1. The exact size and wall thickness of the larger pipe is determined by consideration of water depth and current. As will be appreciated, such large pipe 25 is exceptionally heavy in order to create the structural integrity and allow the well to be self-supporting in the intermediate depth water and the installation of such pipe requires heavy duty barge and crane equipment.

Figure 2:
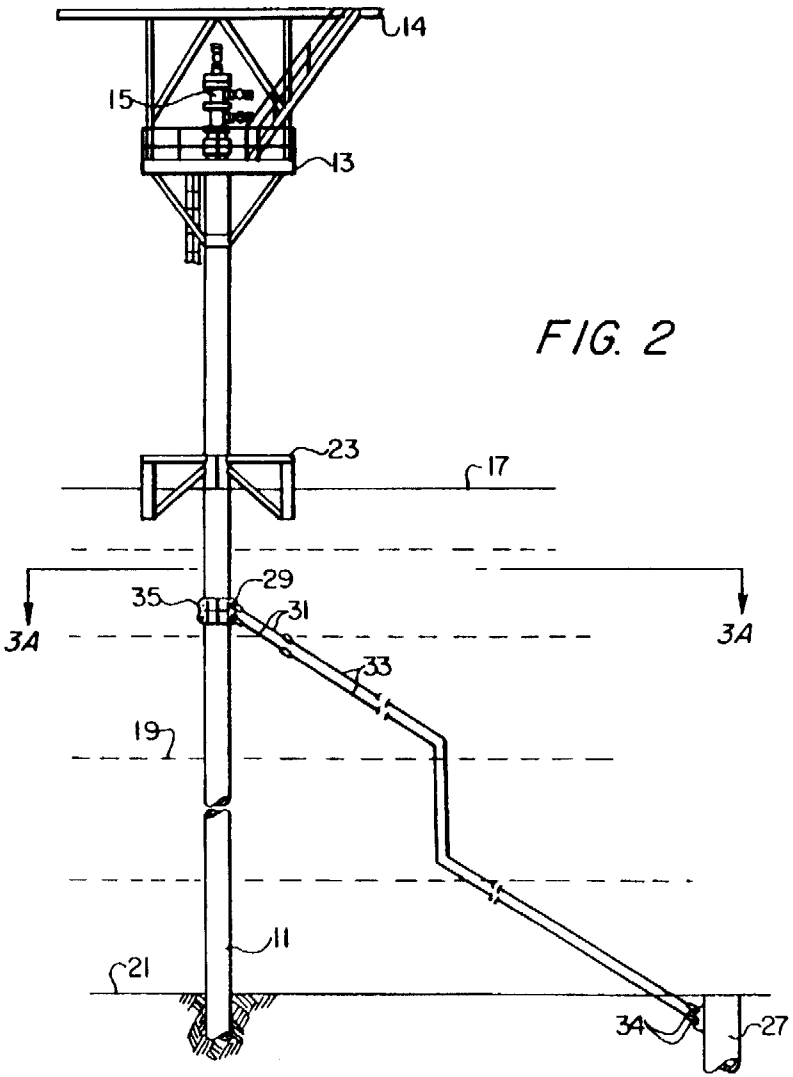
FIG. 2 is a side elevation of a well in a body of water employing the present invention.

Referring to FIG. 2 it is noted that a first embodiment is disclosed and will be described in complete detail hereinafter. It should be understood that the sizes of the respective elements in the apparatus will vary according to the design requirements for providing adequate structural support or the like. More specifically, this embodiment of the invention is provided by a guyed apparatus that can be temporarily employed to provide temporary support until a jacket or deck platform system can be constructed for supporting the well or can optionally be employed as a permanent structure useful over the life of the well.

The well in FIG. 2 includes a main casing 11 supporting the wellhead 15 above the surface 17 of a body of water 19. A conventional boat landing 23 is employed on the well at the surface for accommodating boat traffic to and from the well.

The main casing 11 may comprise any suitable diameter conductor pipe. In the illustrated embodiment it may, for example, comprise a 30 inch diameter conduit. As will be appreciated, a 30 inch diameter pipe has appreciable structural strength. Frequently, however, such strength is inadequate to withstand the lateral forces that could be imposed upon a well completed offshore in more than 60 feet or so of water. Accordingly, it becomes imperative to add addition structural support against such lateral forces. The lateral forces include extraneous natural forces such as waves, wind and the like, as well as man-made forces such as accidental bumping of a boat against the boat landing and the like.

A platform deck 13 will normally be employed on the upper end of the casing and will comprise a conventional type of deck for supporting workers on the wellhead for interconnecting conductor pipe, providing maintenance or control activities. A conventional heliport 14 can also be employed as illustrated in FIG. 2. The platform deck 13 may include guardrails and the like in addition to an expanded or plate metal floor or similar construction. Of course the platform deck may be much larger and support production equipment such as heater treaters, separators for separating gas and liquid phases and even low temperature recovery units. The use of such production equipment on the well can substantially increase the need for lateral force stabilization equipment for the well.

The wellhead 15 will normally comprise any one of many conventional types of wellhead structures including one or more high pressure valves designed to withstand the requisite fluid pressures likely to be encountered at a particular well. Each of the valves will be connected as by way of welded or bolted flange, or the like, to a tubing string that protrudes downwardly interiorly of the main casing 11 and that is completed by the use of packers, perforations and the like into a production zone of a particular subterranean formation that produces the fluid flow from the earth into and through the well in well known manner.

The body of water 19 may be relatively quiet non-moving water or flowing water, such as ocean currents or bay currents. Wells in flowing water obviously require more stabilization than those in quiet waters.

The conventional boat landing 23 may be any of many conventional structures which are structurally adequate to enable off-loading of any material or personnel needed to operate and/or maintain the well. The boat landing is connected with the main casing by way of suitable friction clamps or the like which can be loosened so that the boat landing can be slid upwardly or downwardly along the main casing 11 to accommodate changes in water level.

A plurality of anchor piles 27 (FIG. 4A) are embedded in the bottom 21 of the body of water and with each pile 27 being of sufficient size and shape to make it capable of being driven to below the mud line. Each of the anchor piles 27 comprises 20 inch diameter or greater tubular members in the form of elongate sections of conduit driven below the mud level. In the illustrated embodiment, three equidistantly spaced anchor piles 27 are driven into the bottom at a predetermined distance from the well main casing 11. Of course, the distance would depend upon the depth of the water and the desired degree of support.

As will be made clear hereinafter, the "lower end" of respective cables 33 are preferably fastened to the upper portion of their respective anchor piles before the anchor piles are driven below the mud level. In the illustrated embodiment, the cables have their respective lower ends connected to the respective anchor piles by a speltered connector 33' attached to a padeye 53; the padeye comprises a metallic plate bracket having a pair of apertures 55 and which is welded onto the side of an anchor pile. The anchor pile is driven or vibrated by conventional means into the bottom 21 of the body of water until it is completely below the mud line as shown in FIG. 2.

Cylindrical conduit anchor piles 27 are employed because they are easy to drive into the bottom and because segments of large diameter conduit are readily available in the offshore area and can be economically employed. The padeye bracket is normally welded onto the upper portion of the pile at a position downwardly from the upper end 28 of the pile as shown. The lower ends of cables 33 are then connected to the bracket before the anchor piles are driven into the bottom 21.

Figure 4A:
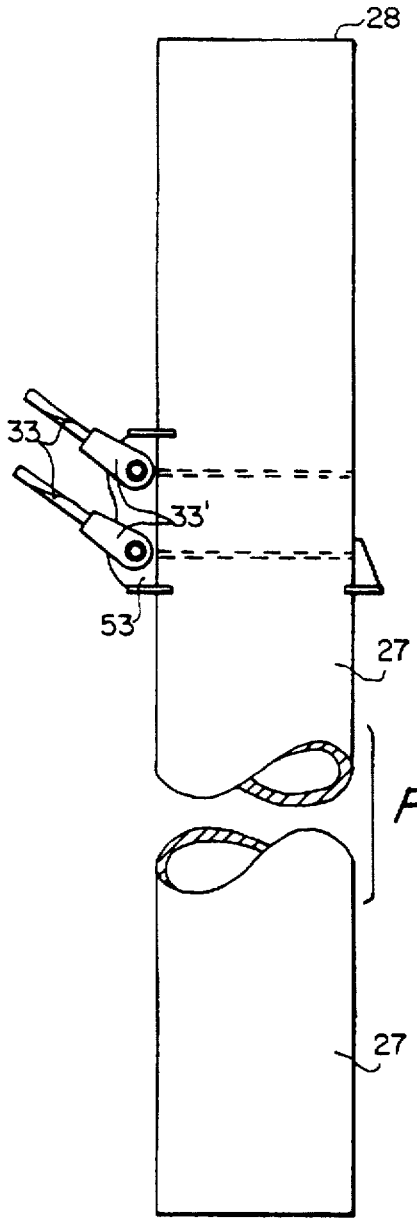
FIG. 4A is a side elevation illustrating the manner of connection of the lower ends of a cable pair to an anchor pile.

Referring to FIG. 4A, the anchor pile members 27 may comprise, for example, 20 inch pipe that is 30 feet in length. A padeye 53 will be affixed, as by welding, to a side of the anchor pile for attachment one of cables 33. The padeye may be from 1 to 15 feet downwardly from upper end 28 of the anchor pile and is illustrated schematically in FIG. 4B to show one of the apertures 55 to which the cable 33 is fastened by means of a speltered end connector 33'. However, it should be understood that any other manner of connecting that will afford a permanent connection of the cable end can be employed.

After the respective lower ends of the cables are connected in their respective apertures 55 on their respective padeyes 53, the respective piles are impact driven or vibrated into the bottom at the desired azimuths and distances equidistant spaced around the well. Thus, the three anchor piles are driven into the bottom at about 120° intervals spaced substantially equidistantly about the main casing 11. An increased number of anchor piles 27 and cables 33 can be employed if required for greater stability. It is also possible for wells not requiring a high degree of stabilization to use only a total of three cables by having only a single cable extending to each anchor pile 27.

Ordinarily, however, it is advantageous to be as spartan in the use of anchor piles and cables to the extent that design will permit. It is vital, however, to use at least three anchor piles and three cables in order to provide protection against lateral forces from any direction.

Figure 5A:
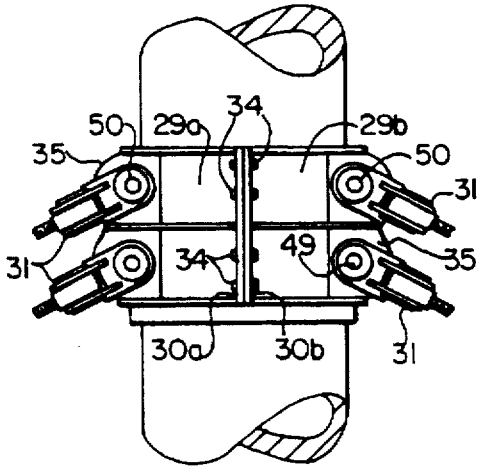
FIG. 5A is a side elevation of the connection of the upper ends of a cable pair to the well casing.

The aforementioned cables are attached to the well casing 11 by a clamp, encircling member, or encircling means 29 which includes multiple components including a first clamp half **29*a* and a second sleeve half 29*b* each of which extends around 180° of the peripheral surface of main casing 11 as shown in FIG. 5A. The clamp half components 29*a* and 29*b* include two facing flange pairs each formed of flanges 29*a*1 and 29*b*1 through which nut and bolt assemblies 34 extend and which operate to clamp the half components 29*a* and 29*b* to well casing 11. It should be understood that only one of the flange pairs is illustrated in FIG. 5A** and that the other flange pair is positioned 180° opposite to the illustrated flange pair.

Support for the upper ends of each of cables 33 is provided by tensioning and restraining means on the cable termination clamp 29 which is itself connected to the main casing 11 at a predetermined minimum distance below the surface of the water as illustrated in FIG. 2. More specifically, three brackets 35 are equidistantly positioned around the periphery of clamp 29 and are welded thereto. Brackets 35 support cable hydraulically actuated cable tensioning devices 31 which are in turn connected to the upper ends of cable members 33 in a manner to be described. A total of six tensioning devices 31 are employed comprising three upper tensioning devices and three lower tensioning devices. It is noted that clamp 29 is positioned at a predetermined minimum depth below the surface of the water, and is held in place by the frictional engagement of the clamp with the outer surface or main conduit 11 resultant from the tightening of nut and bolt assemblies 34.

The upper end of each tensioning device 31 comprises a clevis swivel 50 (FIG. 3B) pivotally mounted by pin means 49 on a respective bracket 35 on clamp 29. Each tensioning device 31 includes two hydraulic cylinders 31D controlled by a conventional hydraulic power supply source 52 through the use of hydraulic high pressure lines 51 each of which is connected to one of the two hydraulic cylinders 31D so that hydraulic fluid from pressure lines 51 actuates cylinders 31D to cause contraction of the cylinders from their deactivated condition of FIG. 3B. The hydraulic power supply source permits all of the pressure lines to be simultaneously provided with hydraulic work fluid at a given pressure; conversely, the lines 51 can be selectively and individually provided with work fluid if desired.

Each of the hydraulically powered tensioning devices 31 (FIG. 3B)includes a fixedly positioned upper block assembly 31A and a movable lower block assembly 31B. Hydraulic cylinder and piston rod assemblies 31D are pivotally attached on their head ends to the fixed upper block assembly 31A and have their piston rods 31R connected to button slings 31E which have their lower ends connected to the movable lower block assembly 31B. The button slings are constructed so that they can be disconnected from movable block 31B when in a slack condition and then reconnected thereto at another point along their length to movable block 31B. The clevis swivels 50 are mounted on fixed upper block assembly 31A for pivotal movement by pin means 31P. A pair of parallel threaded guide rods 31C have their upper ends fixedly mounted in fixedly positioned upper block assembly 31A.

Lower block 31B is mounted so as to be capable of movement along guide rods 31C toward or away from the upper block 31A by rotation of drive nuts 31N threadably mounted on threaded guide rods 31C. The upper end of a cable 33 is fixedly connected (but being capable of disconnection) by conventional connector means to the movable lower block assembly 31B, thus, each cable 33 can be tensioned either by rotation of retainer nuts 31N or by contraction of cylinders 31D of its respective tensioning device 31.

The six cables 33 are pulled taut by the activation of the hydraulic cylinders 31D. The three lower tensioning devices 31 are simultaneously tensioned first to plumb the casing. The upper tension devices 31 are then simultaneously tensioned to exert equal force to designed kips. The lower tension devices 31 are then retensioned, while the upper tensioning devices remain activated, to match the upper kips.

Materials such as high strength steel, non-corrosive steel or the like are employed for all parts to be used in saline water environments. The cables 33 are sized in accordance with conventional engineering criteria to withstand the forces that will be imposed upon them. Movable block 31B includes a conventional poured wire rope socket through which each cable 33 extends and which prevents movement of cable 33 (as viewed in FIG. 3B) relative to block 31B but which permits movement of the block 31B relative to block 31B.

In the preferred illustrated embodiment, the cables are one inch in diameter. There are three cable pairs connected with each cable pair comprising two cables both of which are connected to one of the three anchor piles 27 in the manner shown in FIG. 4A. The upper ends of each cable are connected to one of the hydraulic tensioning devices 31 supported from one of the brackets 35.

A complete cycle of cable tensioning is preceded by the positioning of the cable tensioning devices by means of a crane into position for connection to the padeyes on one of the clamps 29. The complete tensioning assembly is pinned in position and the hydraulic hoses 51 are connected by a diver.

A typical cable tensioning procedure will normally include plural cycles of operation of tensioning devices 31 comprising contraction of hydraulic cylinders 31D to move movable lower block B toward fixed upper block 31A and away from contact with nuts 31N; upon complete contraction of cylinders 31D, drive or retainer nuts 31N would be tightened to engage lower movable block 31B to mechanically prevent it from moving away from fixed block 31A upon subsequent expansion of cylinders 31D to their fully extended position. Button slings 31E are then in slack condition and are disconnected from movable lower block 31B and then reconnected in the most taut condition possible so that subsequent contraction of the hydraulic cylinders will increase tension in the cables. It should be noted that each button sling 31E is simply a cable loop on which plural stop knobs or clamps 31K are attached; one of the knobs 31K of each sling engages one of ear flanges 31L on movable block 31B so as to transmit the force provided by contraction of hydraulic cylinders 31D.

Figure 4B:
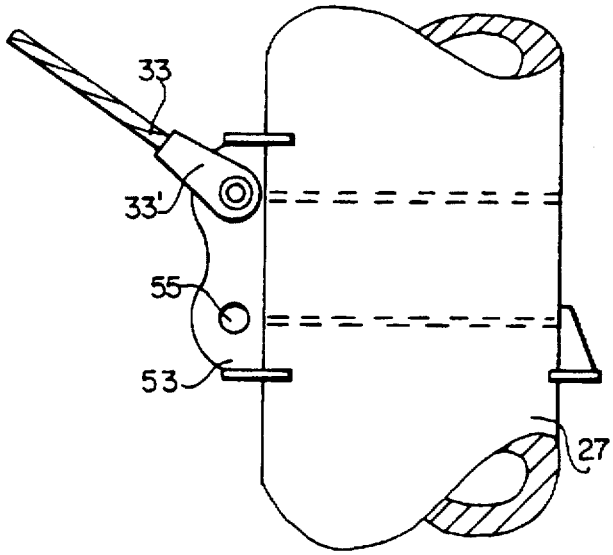
FIG. 4B is an enlargement of FIG. 4A illustrating the manner of connection of the lower end of a single cable to an anchor pile.

The opposite or lower ends of the cables are attached to an anchor pile by means of a pinned speltered connector 33' as shown in FIG. 4B. The location the anchor pile is to be driven is located by mean of an electronic underwater position system and checked with a diver or ROV manual system or Laser Distance Measuring Device. Once the pile location is determined, an underwater impact or vibration hammer is attached to the upper end of the pile and both are lowered into position. The pile is driven or vibrated to the desired depth with the aide of a pneumofathomerer. Once the pile is properly positioned and driven, the same sequence is performed for the remaining two locations. The cables are then connected to the tensioning devices 31 prepatory for this tensioning to effect well stabilization.

The casing is monitored to ensure that when tensioning commences, the well stays plumb. The process begins by first tensioning the lower cables of each cable pair to some pre-designed value that will ensure that the slack is removed from the cables. The hydraulic operator then tensions the upper cables of each cable pair. This procedure continues in the manner previously discussed until all of the cables are tensioned to a pre-determined engineered value (40 or more kips).

Figure 5B:
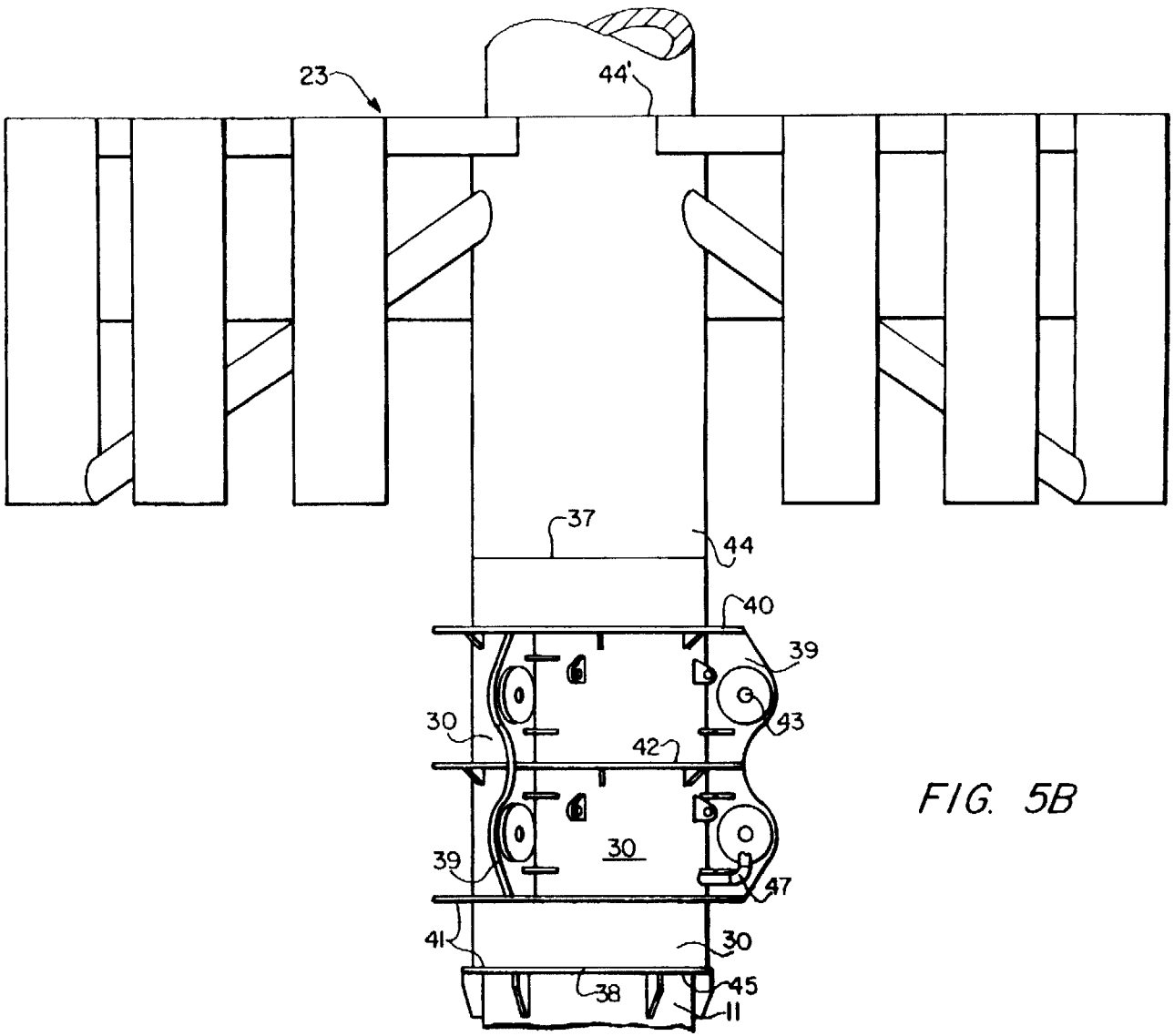
FIG. 5B is a side elevation illustrating an alternative embodiment in which the upper ends of cable pairs are connected to the casing by a sleeve and also illustrating a boat landing structure provided on the casing.

FIG. 5B illustrates a second embodiment of the invention which employs a termination sleeve 30 having an upper end 37 and a lower end 38. Termination sleeve 30 differs from clamp 29 in that it is not clamped to casing 11 but is instead held in position by epoxy grouting. Sleeve 30 is of cylindrical configuration and has an inner diameter slightly greater than the outer diameter of main casing 11. Three identical bracket plates 39 extend radially from termination sleeve 30 and are equally spaced from each other approximately 120°. Only two of the bracket plates are illustrated in FIG. 5B. The third bracket plate which is not illustrated is on the opposite side of the sleeve.

The upper ends of bracket plates 39 are engaged by an upper radial flange 40 and the lower ends are engaged by a lower radial flange 41. A middle flange 42 extends radially from the outer surface of termination sleeve 30 and comprises three separate flange elements each of which is positioned between and welded between two of the bracket plates 39. Bracket plates 39 serve the same function as brackets 35 of the clamp 29. Openings 43 and bracket plates 39 are provided for permitting the connection of the hydraulic tensioning devices 31 in the same manner as previously described.

The upper end 37 of termination sleeve 30 is welded to the lower end of a main sleeve 44 of boat landing 23. Main sleeve 44 is of the same outer and inner diameter as termination sleeve 30. The lower end 38 of termination sleeve 30 rests on a support flange 45 which is welded to the outer surface of main casing 11.

Boat dock 23 and sleeve 30 are positioned over casing 11 in a concentric manner and are maintained in position by spacer blocks on the interior of termination sleeve 30 which engage the outer surface of casing 11 so as to provide an annular space internally of termination sleeve 30 into which high strength epoxy grout is injected through injection pipe 47. Upon hardening of the epoxy, sleeve 30 is rigidly and fixedly positioned with respect to casing 11. The top 44' of sleeve 44 is then welded to casing 11.

The illustrated boat landing 23 of FIG. 5B encompasses only one side of the main casing 11 in the illustrated embodiment and may optionally be connected to the main casing by means of clamps or by welding if desired rather than being connected by sleeve 30 in the manner previously discussed. In any event, the boat landing has an expanded metal grill floor and includes structural members extending laterally from the well and engaging vertical structural members.

After the tensioning is completed, the hydraulic system is removed by divers and the system is ready for the decks to be placed on the casing. Depending on the size and weight of the decks, this will be accomplished with the drilling rig, jackup workboat or a derrick barge. The cables are positioned at a depth considerably exceeding the draft of any workboat or barge so as to avoid engagement by them.

The "cable guyed" casing can be employed to provide temporary support until a jacket or deck platform system can be constructed about a given well completed in an offshore environment. In such an instance, the cables would then be removed and the jacket would be either stabbed over the well or set beside the well so that it could be easily attached thereto to promote structural support. However the guyed cable well structure can be a permanent design offshore structure since, it has all the flexibility desired and is much more economical than the prior art approaches. Addition wells may be added both internal or external of the main casing.

Among the many advantages of the present invention is that it can be employed with a minimum amount of equipment and personnel so as to be far more economical than have been prior known procedures. Moreover, the economic savings involved in the use of the invention are of particular value in foreign operations. Moreover, the inventive system permits an easy rechecking of the tension in the cables on a regular basis so that they can be retensioned when required to as to maintain a reliable support for preventing well movement. One of the greatest advantages of the present invention is that it permits a well do go on stream many months before a conventional system could be started. Thus, very substantial monetary benefits flow from use of the invention.

Additionally, the inventive system can be easily and safely employed adjacent to a live well.

Thus it can be seen that this invention achieves all of the objects delineated herein before.

Although this invention has been described with a certain degree of particularity, it is understood that the present disclosure is made only by way of example and that numerous changes in the details of construction and the combination and arrangement of parts may be resorted to without departing from the spirit and the scope of the invention, reference being had for the latter purpose to the appended claims. For example, the order of attaching the cable ends in the method of operation can be reversed from that previously described.

What is claimed is:

1. A method of saving a completed well, located in a body of water and having a main casing protruding above the surface of a body of water, said method comprising the steps of:

a. fixedly attaching an encircling member to the main casing at a desired depth below said surface of the body of water with epoxy grout to hold said encircling member in position on said main casing and welding said encircling member to said main casing at a point above said surface of the body of water;

b. attaching a group of hydraulically operated tensioning devices employing hydraulic cylinders for providing force exertion on a cable end retaining member;

c. attaching a first respective end of each of a first group of at least three cables to a respective one of at least three anchor piles;

d. attaching a second respective end of each cable of said first group of cables to a respective one of said cable end retaining members;

e. positioning each respective anchor pile in a predetermined azimuth and distance about the main casing;

f. moving the pile into a bottom of said body of water until it is deeply embedded in said bottom;

g. actuating said hydraulically operated tensioning devices to place all of said cables in equal tension; and h. retaining said cables in equal tension.

2. The method of claim 1 wherein said hydraulically operated tensioning devices are operated simultaneously to create equal tension in all of said cables.

3. The method of claim 2 including the further steps of mechanically locking said cables in their tensioned condition for retaining said cables in equal tension and subsequently removing said hydraulic cylinders from said hydraulically operated tensioning devices.

4. The method of claim 1 including the further steps of:

i. mechanically locking said cables in their tensioned condition for effecting the retention of said cables in equal tension; and j. removing said hydraulic cylinders from said hydraulically operated tensioning devices.

5. The method of claim 1 including the additional steps of:

k. attaching to said encircling member a second group of hydraulically operated tensioning devices employing hydraulic cylinders for providing force exertion on a cable end retaining member;

l. attaching a first respective end of each of a second group of at least three cables to a respective one of said three anchor piles;

m. attaching a second respective end of each cable of said second group of cables to a respective one of said second group of hydraulically operated tensioning devices;

n. subsequent to step (h) actuating said second group of hydraulically operated tensioning devices to place all of said cables of said second group of cables in equal tension with the cables of the first group; and o. mechanically retaining said cables of said first and second groups of cables in equal tension.

6. The method of claim 1 including the step of injecting said epoxy grout between said encircling member and said main casing for holding said encircling member in position on said main casing.

7. The method as defined in claim 6 wherein said epoxy grout is injected between said encircling means and said well casing through an injection pipe.

8. A method as defined in claim 6 further comprising the step of welding said encircling member to said well casing at a point above said surface of the body of water after said grout is injected between said encircling member and said main casing.

* * * * *